US008886067B2

(12) United States Patent
Hano

(10) Patent No.: US 8,886,067 B2
(45) Date of Patent: Nov. 11, 2014

(54) IMAGE FORMING APPARATUS FOR ADJUSTING IMAGE FORMING CONDITIONS

(71) Applicant: Canon Kabushiki Kaisha, Tokyo (JP)

(72) Inventor: Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 13/717,208

(22) Filed: Dec. 17, 2012

(65) Prior Publication Data

US 2013/0156451 A1 Jun. 20, 2013

(30) Foreign Application Priority Data

Dec. 19, 2011 (WO) ..... PCT/JP2011/079340

(51) Int. Cl.
*G03G 15/00* (2006.01)
*G03G 15/16* (2006.01)
*G03G 15/01* (2006.01)

(52) U.S. Cl.
CPC ..... *G03G 15/1695* (2013.01); *G03G 15/5058* (2013.01); *G03G 15/0189* (2013.01); *G03G 15/5041* (2013.01)
USPC ..... 399/49; 399/66

(58) Field of Classification Search
USPC ..... 399/49, 66, 301
See application file for complete search history.

(56) References Cited

FOREIGN PATENT DOCUMENTS

JP 2004-012582 A 1/2004
JP 2007-286445 A 11/2007

*Primary Examiner* — Walter L Lindsay, Jr.
*Assistant Examiner* — Barnabas Fekete
(74) *Attorney, Agent, or Firm* — Canon USA, Inc. IP Division

(57) ABSTRACT

An image forming apparatus in which an optical sensor for detecting an adjustment toner image of black color is disposed on an image bearing member and an optical sensor for detecting adjustment toner images of other colors is disposed on an intermediate transfer member. With this configuration, even if the adjustment toner images of black and other colors simultaneously pass through a transfer portion for black color to reduce downtime, it is possible to reduce an effect on the subsequent image caused by light irradiation from the optical sensor and, at the same time, to prevent adjustment toner images of other colors from being excessively retransferred to the image bearing member (for black color) due to discharge. Control is performed such that a voltage less than a discharge start voltage is applied.

7 Claims, 17 Drawing Sheets

IMAGE FORMING APPARATUS FOR ADJUSTING IMAGE FORMING CONDITIONS

BACKGROUND OF THE INVENTION

1. Field of the Invention

The present disclosure generally relates to image forming and, more particularly, to an image forming apparatus that optically detects adjustment toner images formed on image bearing members, and adjusts image forming conditions based on a result of the detection.

2. Description of the Related Art

To accommodate various types of recording materials, it is preferable, in an image forming apparatus, that adjustment toner images be formed and detected for adjustment of image forming conditions. The image forming apparatus includes an intermediate transfer member to which toner images are transferred from a plurality of image bearing members each having a photosensitive layer.

Conventionally, there has been a configuration in which an optical sensor that detects adjustment toner images is disposed to face an intermediate transfer member. In this configuration, however, repeated use of the image forming apparatus causes contamination of the surface of the intermediate transfer member and lowers the gloss of the surface of the intermediate transfer member. As the surface of the intermediate transfer member becomes darker in color, it becomes difficult to distinguish an adjustment toner image of black color from the surface of the intermediate transfer member. This means that it becomes difficult to detect the adjustment toner image of black color. To detect the adjustment toner image of black color even after repeated use of the image forming apparatus, it is preferable that adjustment toner images of other colors be detected on the intermediate transfer member and the adjustment toner image of black color be detected on an image bearing member. Since there is only a limited space between the image bearing member for black color and image bearing members for other colors, it is preferable that an optical sensor that detects adjustment toner images of other colors be disposed downstream of a transfer unit (for black color) to face the intermediate transfer member.

To detect the adjustment toner image of black color on the image bearing member, the optical sensor irradiates the adjustment toner image on the image bearing member with light. If the image bearing member is negatively charged, the potential of the region irradiated with light by the optical sensor is shifted in the positive direction. If a positive voltage is applied to the transfer unit when the adjustment toner image passes therethrough, the potential of the region irradiated with light by the optical sensor is further shifted in the positive direction. As a result, the polarity of the potential of the surface of the image bearing member may be reversed from negative to positive. This may cause image defects in the subsequent image formation.

Japanese Patent Application Laid-Open No. 2007-286445 describes a configuration in which an optical sensor that detects adjustment toner images is disposed to face an image bearing member. In the configuration described in Japanese Patent Application Laid-Open No. 2007-286445, to reduce traces of light irradiation from the optical sensor, a voltage of negative polarity higher than a discharge start voltage is applied to a transfer unit when a region where adjustment toner images on the image bearing member are irradiated with light passes through the transfer unit.

To reduce downtime, it is preferable that adjustment toner images of black and other colors be arranged in the width direction and simultaneously passed through the transfer unit.

However, if the method described in Japanese Patent Application Laid-Open No. 2007-286445 is used in which a voltage higher than the discharge start voltage is applied, a discharge occurs between an intermediate transfer belt and the image bearing member when the adjustment toner images of black and other colors simultaneously pass through the transfer unit (for black color). The discharge causes the adjustment toner images of other colors to be excessively retransferred to the image bearing member. This means that before being detected by an optical sensor on the downstream side, the adjustment toner images of other colors are excessively reduced in amount.

SUMMARY OF THE INVENTION

To solve the problems described above, according to an aspect of the present disclosure, an image forming apparatus is provided that includes an intermediate transfer member configured to be a movable member to which toner images are transferred; a first image bearing member configured to come into contact with the intermediate transfer member, the first image bearing member having a photosensitive layer bearing a chromatic toner image of a first polarity; a second image bearing member configured to come into contact with the intermediate transfer member at a location downstream of the first image bearing member in a direction of travel of the intermediate transfer member, the second image bearing member having a photosensitive layer bearing a black toner image of the first polarity; a first transfer member configured to transfer a toner image from the first image bearing member to the intermediate transfer member at a first transfer portion; a second transfer member configured to transfer a toner image from the second image bearing member to the intermediate transfer member at a second transfer portion; a voltage applying member configured to apply a voltage to the first transfer member and the second transfer member; a first detector configured to detect an adjustment toner image of chromatic color by irradiating the intermediate transfer member with light, the first detector being disposed downstream of the second image bearing member in the direction of travel of the intermediate transfer member; a second detector configured to detect an adjustment toner image of black color by irradiating the second image bearing member with light; and an adjusting portion configured to adjust an image forming condition for the first image bearing member based on a result obtained using the first detector by detecting a first adjustment toner image transferred from the first image bearing member to the intermediate transfer member, and adjusting an image forming condition for the second image bearing member based on a result obtained using the second detector by detecting a second adjustment toner image formed on the second image bearing member. In the image forming apparatus, the voltage applying member is controlled such that when the first adjustment toner image and the second adjustment toner image simultaneously pass through the second transfer portion in the direction of travel of the intermediate transfer member, a first voltage of the first polarity is applied to the second transfer member, the first voltage being a voltage that makes a potential difference between the second image bearing member and the intermediate transfer member less than a discharge start voltage.

Further features of the present disclosure will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles of the disclosure.

DESCRIPTION OF THE EMBODIMENTS

A copier, which is an embodiment of an image forming apparatus of the present disclosure, will now be described in detail with reference to the drawings. The image forming apparatus of the present disclosure is not limited to specific configurations of embodiments to be described below.

Embodiment (Overview of Image Forming Apparatus)

Figure 1:
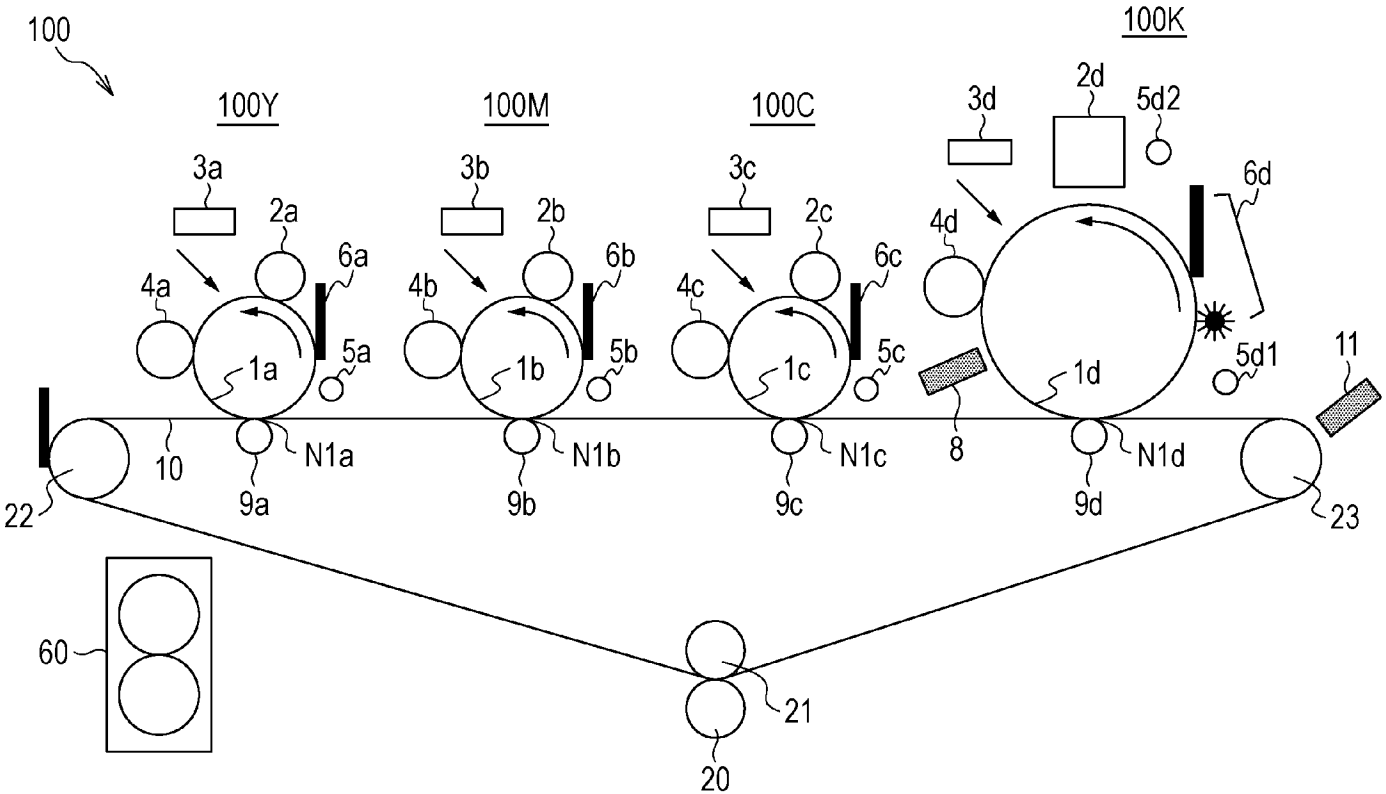
FIG. 1 schematically illustrates a configuration of an image forming apparatus according to an embodiment.

FIG. 1 schematically illustrates an overall configuration of a copier, which is an image forming apparatus 100 according to an embodiment. Yellow, magenta, cyan, and black toner images are formed by image forming stations 100Y, 100M, 100C, and 100K, respectively, which serve as image forming units that form toner images of respective colors.

In the image forming stations described above, the surfaces of photosensitive drums 1*a*, 1*b*, 1*c*, and 1*d*, each having a photosensitive layer of organic photo-semiconductor (OPC) with negative charging characteristics, are uniformly charged (at a voltage of −900 V) by the corresponding charging devices 2*a*, 2*b*, 2*c*, and 2*d*. The surfaces of the photosensitive drums 1*a*, 1*b*, 1*c*, and 1*d* are exposed to light for optical writing by the corresponding laser beam scanning exposure devices 3*a*, 3*b*, 3*c*, and 3*d*. The light exposure changes the potential of the surfaces of the photosensitive drums to −300 V. Thus, electrostatic images are formed on the respective surfaces of the photosensitive drums. Additionally, developing devices 4*a*, 4*b*, 4*c*, and 4*d* develop the electrostatic images on the photosensitive drums to form toner images with toner, which is a developer. A direct current (DC) voltage of −720 V and an alternating current (AC) voltage of 1300 Vpp are applied to the developing devices 4*a*, 4*b*, 4*c*, and 4*d*. Thus, toner images are formed on the respective photosensitive drums.

In the present embodiment, the photosensitive drums 1*a*, 1*b*, and 1*c* are 30 mm in diameter, whereas the photosensitive drum 1*d* is 84 mm in diameter. Using the photosensitive drums of different diameters is advantageous in terms of space saving, monochrome print ratio, and product life. In the present embodiment, the charging devices 2*a*, 2*b*, and 2*c* are charging rollers, whereas the charging device 2*d* is a corona charger.

The toner images formed on the photosensitive drums 1*a*, 1*b*, 1*c*, and 1*d* are primary-transferred to an intermediate transfer belt 10 by applying a transfer voltage to primary transfer rollers 9*a*, 9*b*, 9*c*, and 9*d*. In the present embodiment, a voltage (800 V) of positive polarity (second polarity) opposite the negative polarity (first polarity), which is a normal charging polarity of toner, is applied as a transfer voltage. The primary transfer rollers 9*a*, 9*b*, 9*c*, and 9*d* press the respective photosensitive drums, with the intermediate transfer belt interposed therebetween, to form primary transfer nips N1*a*, N1*b*, N1*c*, and N1*d*, respectively, at which the toner images are transferred. The transfer rollers 9*a*, 9*b*, 9*c*, and 9*d* used here may have a resistance value of $1\times10^2$ to $1\times10^8$ when a voltage of 2 kV is applied thereto under a measurement environment of 23° C. in temperature and 50% in humidity.

After the primary transfer, the surfaces of the photosensitive drums 1*a*, 1*b*, 1*c*, and 1*d* are uniformly exposed to light for charge elimination by charge eliminating devices 5*a*, 5*b*, 5*c*, and 5*d*1. Then, the surfaces of the photosensitive drums are cleaned by cleaning devices 6*a*, 6*b*, 6*c*, and 6*d*. The cleaning devices 6*a*, 6*b*, and 6*c* are cleaning blades, whereas the cleaning device 6*d* is composed of a cleaning blade and a fur brush. In the image forming station 100K, the surface of the photosensitive drum 1*d* cleaned by the cleaning device 6*d* is further subjected to charge elimination by a charge eliminating device 5*d*2. This is because unevenness in voltage tends to occur on the surface of the photosensitive drum 1*d*, which is irradiated with light by an optical sensor 8.

The intermediate transfer belt 10 is a movable belt member stretched by stretching rollers 21, 22, and 23 and configured to bear and convey toner images. The overall resistance of the intermediate transfer belt 10 is adjusted to a volume resistivity of $1\times10^9$ Ω·cm to $1\times10^{11}$ Ω·cm and to a surface resistivity of $1\times10^{11}$ Ω·cm$^2$ to $1\times10^{13}$ Ω·cm$^2$.

Recording materials are stored in a cassette (not shown). A recording material is supplied in synchronization with conveyance of toner images on the intermediate transfer belt 10.

A secondary transfer roller 20 is disposed to face the stretching roller 21. The secondary transfer roller 20 serves as a transfer member that forms a secondary transfer nip at which toner images are transferred onto a recording material. A secondary transfer high-voltage power supply with a variable supply bias is connected to the secondary transfer roller. That is, the secondary transfer high-voltage power supply functions as a voltage applying member that applies a voltage to the secondary transfer roller. When a recording material is conveyed to the secondary transfer nip, a transfer voltage of polarity opposite that of toner is applied to the secondary transfer roller 20, so that toner images on the intermediate transfer belt 10 are electrostatically transferred together onto the recording material.

After the transfer, the recording material is conveyed to a fixing device 60, where the toner image is fixed to the recording material by application of heat and pressure. After the toner image is fixed, the recording material is discharged to the outside of the apparatus.

A control unit 12 is a typical computer control device having a calculating function and programmed. The control unit 12 comprehensively controls all parts of the image forming apparatus 100 to form an image on a recording material.

The control unit 12 functions as an executing unit capable of executing both a monochrome image forming mode and a full-color image forming mode. The full-color image forming mode is executed while the photosensitive drums 1*a*, 1*b*, 1*c*, and 1*d* are in contact with the intermediate transfer belt 10. The monochrome image forming mode is executed while the photosensitive drum 1*d* is in contact with the intermediate transfer belt 10 and the photosensitive drums 1*a*, 1*b*, and 1*c* are spaced from the intermediate transfer belt. The control unit 12 thus functions as an executing unit that executes these modes.

(Arrangement and Configuration of Optical Sensors)

In the present embodiment, adjustment toner images are formed to adjust the density of developer. The adjustment toner images are detected using optical sensors. The adjustment toner images may also be referred to as patch images.

First, the arrangement of the optical sensors will be described. Repetition of image formation lowers the gloss of the intermediate transfer member. As the intermediate transfer member becomes darker in color, it becomes difficult to distinguish an adjustment toner image of black color from the intermediate transfer member. This means that the accuracy of detecting the adjustment toner image of black color on the intermediate transfer member is degraded. To suppress degradation in the accuracy of detecting the adjustment toner image of black color using the optical sensor even after repetition of image formation, it is preferable that adjustment toner images of other colors be detected on the intermediate transfer member and the adjustment toner image of black color be detected on the image bearing member.

Figure 2:
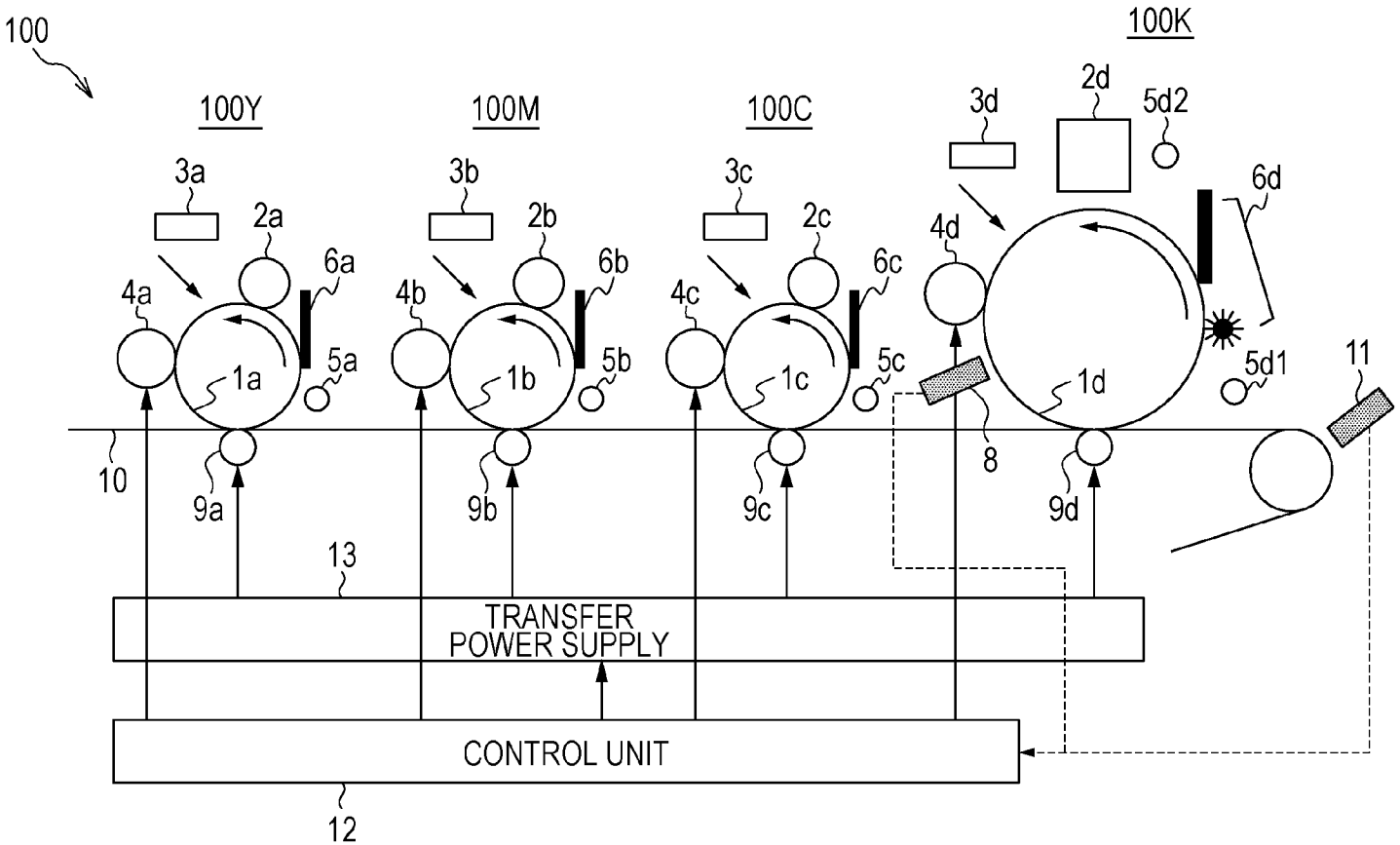
FIG. 2 schematically illustrates a configuration of photosensitive drums and their vicinity according to the embodiment.

Thus, as illustrated in FIG. 2, an optical sensor 11 (first detector) is disposed to face the intermediate transfer member 10. The optical sensor 11 functions as a detector that detects adjustment toner images of chromatic colors (yellow, magenta, and cyan colors) formed by the image forming stations 100Y, 100M, and 100C. This means that no optical sensor is disposed to face the photosensitive drums 1*a*, 1*b*, and 1*c* (first image bearing member) for toners of chromatic colors. Since there is only a limited space between the photosensitive drum 1*d* for achromatic color (black) and the photosensitive drum 1*c*, the optical sensor 11 is disposed downstream of the image forming station 100K and upstream of the secondary transfer roller 20 in the direction of travel of the intermediate transfer belt 10.

As a detector that detects an adjustment toner image of black color formed by the image forming station 100K, the optical sensor 8 (second detector) is disposed to face the photosensitive drum 1*d* (second image bearing member). The optical sensor 8 is located directly below the developing device 4*d* in the vertical direction. In the direction of movement of the photosensitive drum 1*d*, the optical sensor 8 is disposed downstream of the developing device 4*d* and upstream of the primary transfer nip N1*d*.

Figure 3:
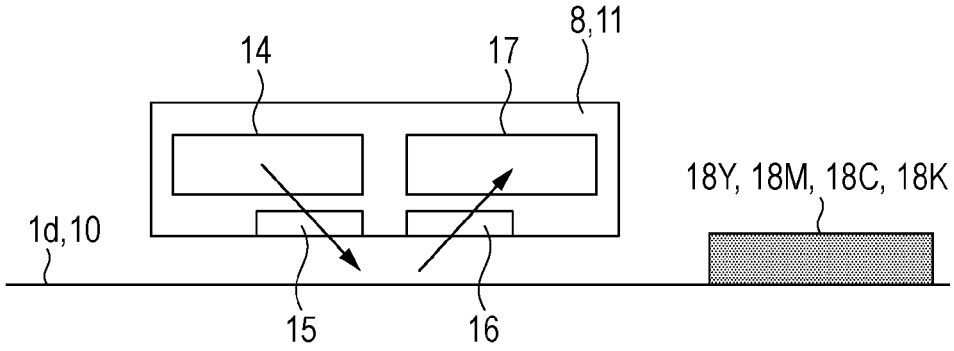
FIG. 3 illustrates exposure to light from an optical sensor.

Next, the configuration of the optical sensors 8 and 11 will be described with reference to FIG. 3. The optical sensors 8 and 11 each include an illumination window 15, an LED 14 serving as a light-emitting unit that emits light, a light-receiving window 16, and a photodiode 17 serving as a light-receiving unit that receives reflected light.

In the present embodiment, a directional light emitting diode (LED) having a central wavelength of 880 nm (and a half-width of 50 nm) and manufactured by Stanley Electric Co., Ltd. is used. Irradiation light has a width of 7 mm in the width direction perpendicular to the direction of travel of the intermediate transfer member. With an optical power meter manufactured by ADC Corporation, the amount of irradiation light is set such that the amount of light is 100 μW. It is to be understood that there is no intention to limit the present disclosure to the numerical values described above.

Adjustment toner images 18Y, 18M, and 18C for the intermediate transfer belt-facing sensor are formed on the photosensitive drums 1*a*, 1*b*, and 1*c*, respectively, by the control unit 12 using the corresponding charging devices 2*a*, 2*b*, and 2*c*. An adjustment toner image 18K for the photosensitive drum-facing sensor is formed on the photosensitive drum 1*d* by the control unit 12 using the charging device 2*d*. When the adjustment toner images 18Y, 18M, and 18C for the intermediate transfer belt-facing sensor pass through the optical sensor 11, voltage signals corresponding to the respective densities of the adjustment toner images 18Y, 18M, and 18C are output as a result of the detection. When the adjustment toner image 18K for the photosensitive drum-facing sensor passes through the optical sensor 8, a voltage signal corresponding to the density of the adjustment toner image 18K is output as a result of the detection. After determining the densities of the adjustment toner images 18Y, 18M, 18C, and 18K on the basis of these voltage signals, the control unit 12 controls developer densities or high voltages for the corresponding developing devices 4*a*, 4*b*, 4*c*, and 4*d*.

(Adjustment Toner Images)

In the present embodiment, adjustment toner images are formed in an inter-sheet space during image formation, and during the previous rotation before start of the image formation. When adjustment toner images are formed in an inter-sheet space, the length of the adjustment toner images is decreased for higher productivity. On the other hand, when adjustment toner images are formed during the previous rotation, the length of the adjustment toner images is increased for better accuracy in adjustment. Specifically, when adjustment toner images are formed in an inter-sheet space, the length of the adjustment toner image of each color is 200 mm in the direction of travel of the intermediate transfer belt. The circumference of the photosensitive drum 1*d* is 264 mm. Therefore, when adjustment toner images are formed between sheets, the length of the adjustment toner image of each color is smaller than or equal to the circumference of the photosensitive drum 1*d*. On the other hand, when adjustment toner images are formed during the previous rotation, the length of the adjustment toner image of each color is 912 mm. That is, the length of the adjustment toner images formed during the previous rotation is longer than the circumference of the photosensitive drum 1*d*.

Note that when adjustment toner images are formed either between sheets or during the previous rotation, the width of the adjustment toner image of each color is about 2 cm in the width direction perpendicular to the direction of travel of the intermediate transfer belt.

(Transfer High-Voltage Control in Full-Color Image Formation)

In full-color image formation, adjustment toner images are formed in an inter-sheet space between recording materials. The setting of a voltage applied to the primary transfer rollers for forming a full-color image on a recording material will now be described.

Figure 5:
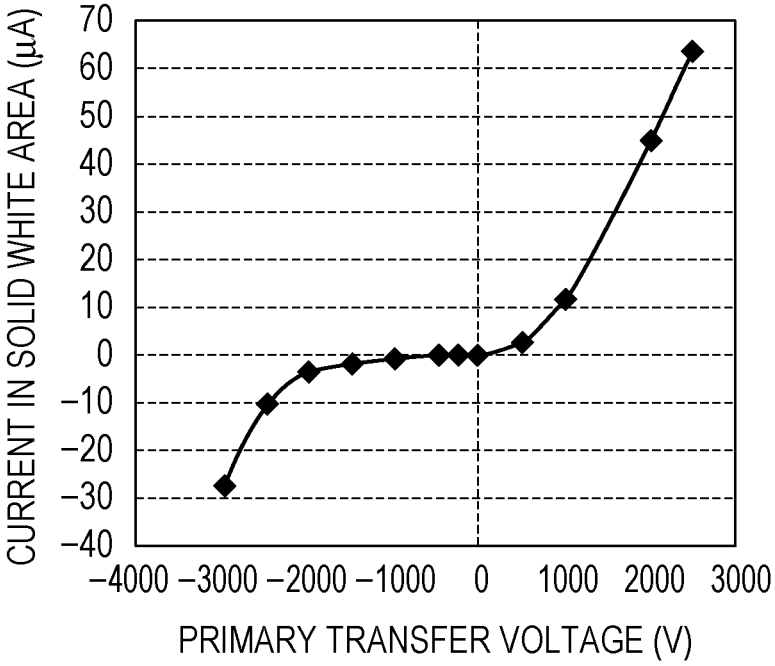
FIG. 5 is a diagram illustrating a current in a solid white area with respect to a transfer voltage.

FIG. 5 is a diagram illustrating a current in a solid white area with respect to a primary transfer voltage applied under an environment of 23° C. in temperature and 50% in humidity. Referring to FIG. 5, in the present embodiment, when toner images to be formed on a recording material pass through the primary transfer nips, a voltage of 800 V is applied to the primary transfer rollers 9*a*, 9*b*, 9*c*, and 9*d* as a transfer voltage for transferring the toner images.

Next, a description will be given of the setting of a voltage applied to the primary transfer rollers when adjustment toner images pass through the primary transfer nips N1*a*, N1*b*, and N1*c* (first transfer portion). Since the optical sensor 11 for detecting the adjustment toner images 18Y, 18M, and 18C of chromatic colors faces the intermediate transfer belt, it is necessary to transfer the adjustment toner images 18Y, 18M, and 18C from the photosensitive drums 1*a*, 1*b*, and 1*c* to the intermediate transfer belt. Therefore, when the adjustment toner images 18Y, 18M, and 18C on the photosensitive drums 1*a*, 1*b*, and 1*c* pass through the primary transfer nips N1*a*, N1*b*, and N1*c*, a voltage equal to the transfer voltage for normal image formation is applied to the primary transfer rollers 9*a*, 9*b*, and 9*c* (first transfer member). Thus, the adjustment toner images 18Y, 18M, and 18C are transferred onto the intermediate transfer member 10.

Figure 4:
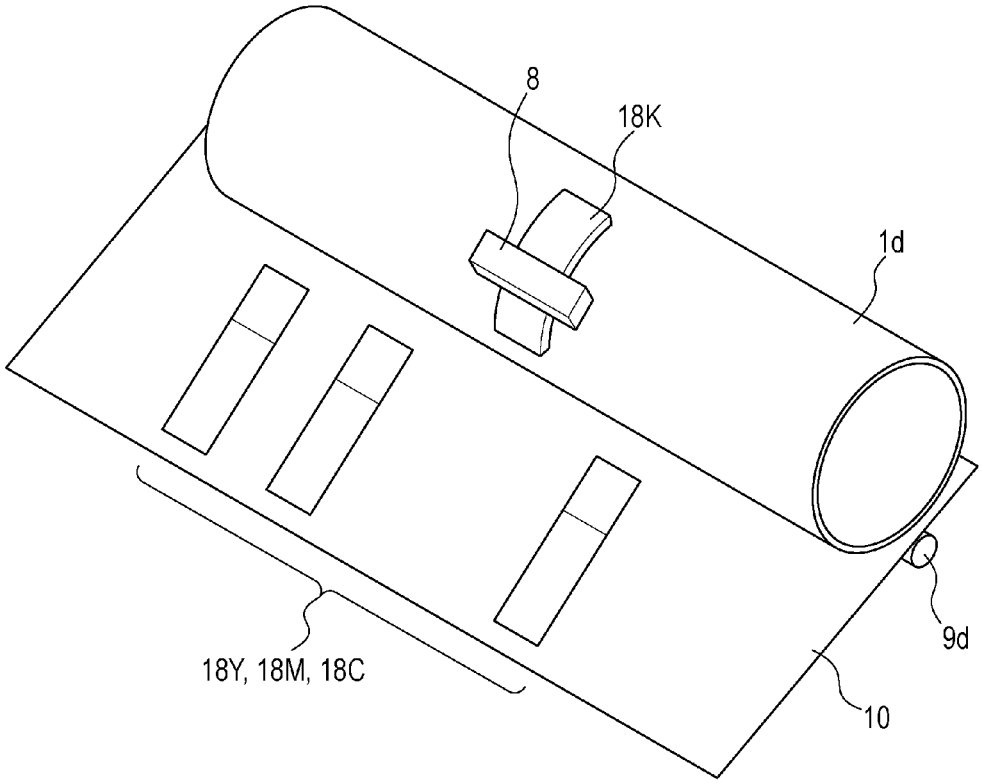
FIG. 4 is a bird's-eye view illustrating an entry into a transfer portion in full-color image formation.

The adjustment toner images 18Y, 18M, and 18C for the intermediate transfer belt-facing sensor (first adjustment toner image) and the adjustment toner image 18K for the photosensitive drum-facing sensor (second adjustment toner image) simultaneously pass through the primary transfer nip N1*d* for black color. This is to suppress widening of an inter-sheet space for forming adjustment toner images. This means that the adjustment toner images 18Y, 18M, and 18C for the intermediate transfer belt-facing sensor and the adjustment toner image 18K for the photosensitive drum-facing sensor are formed at different positions in the direction perpendicular to the direction of travel of the intermediate transfer member, and at the same position in the direction of travel of the intermediate transfer member. FIG. 4 illustrates a state immediately before the adjustment toner images 18Y, 18M, and 18C for the intermediate transfer belt-facing sensor reach the transfer roller 9*d*.

Next, a description will be given of the setting of a voltage applied to the primary transfer roller when adjustment toner images pass through the primary transfer nip N1*d* for black color (second transfer portion).

In the present embodiment, the control unit 12 controls a transfer power supply 13 to apply, as a voltage of negative polarity (first polarity equal to the polarity of toner) lower than a discharge start voltage, a voltage of −720 V to the primary transfer roller 9*d* (second transfer member) when the adjustment toner images 18Y, 18M, 18C, and 18K simultaneously pass through the primary transfer nip N1*d*. The reason for this will now be described.

Before the adjustment toner image 18K of black color on the photosensitive drum 1*d* reaches the primary transfer nip N1*d*, the optical sensor 8 irradiates the adjustment toner image 18K with light. As a result, the potential of the region irradiated by the optical sensor 8 is shifted in the positive direction to −100 V. If a voltage of positive polarity (second polarity) is applied to the primary transfer roller 9*d* when the irradiated region passes through the primary transfer nip N1*d*, the potential of the irradiated region is further shifted in the positive direction. As a result, if the potential of the irradiated region is reversed to the positive polarity, there may be an effect on the subsequent image formation. To reduce the effect on the subsequent image formation, applying a voltage of negative polarity (first polarity) to the primary transfer roller 9*d* is effective.

Figure 7:
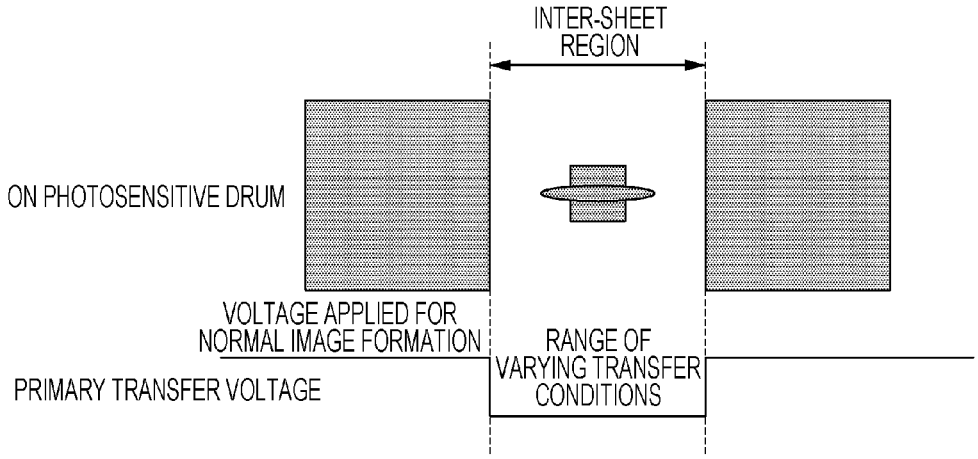
FIG. 7 illustrates transfer voltage control between sheets.

As illustrated in FIG. 7, the adjustment toner image 18K for the photosensitive drum-facing sensor is formed between sheets during color image formation. Here, a relationship between a voltage applied to the primary transfer roller in the inter-sheet space and the occurrence of exposure traces in the subsequently formed image was examined. Table 1 below shows the result.

TABLE 1

| | Primary Transfer Voltage | | | | | | |
|---|---|---|---|---|---|---|---|
| | −2000 | −1500 | −1000 | −500 | 0 | 100 | 200 |
| Exposure Traces | NO | NO | NO | NO | YES | YES | YES |

As shown in Table 1, exposure traces were produced when a voltage applied to the primary transfer roller was 0 or of positive polarity (second polarity), whereas no exposure traces were produced when a voltage applied to the primary transfer roller was of negative polarity (first polarity). To reduce the occurrence of exposure traces, applying a voltage of negative polarity (first polarity) to the primary transfer roller is effective. This is because the potential of the irradiated portion of the adjustment toner image 18K for the photosensitive drum-facing sensor is suppressed to the potential of negative polarity (first polarity), which does not cause the occurrence of exposure traces.

Figure 8:
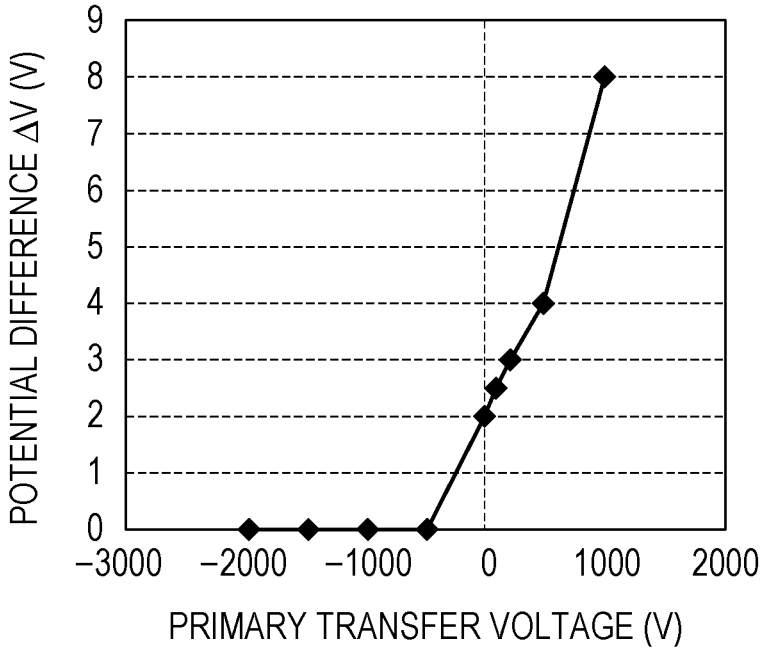
FIG. 8 illustrates a potential difference caused by exposure traces with respect to a transfer voltage.

FIG. 8 illustrates a relationship between a voltage applied to the primary transfer roller in an inter-sheet space, and a potential difference between an irradiated region and a non-irradiated region. In FIG. 8, the horizontal axis represents a voltage applied to the primary transfer roller, and the vertical axis represents a potential difference ΔV. When an image is formed after the formation of the adjustment toner image 18K for the photosensitive drum-facing sensor, a potential difference occurs, on the photosensitive drum 1*d*, between an irradiated region irradiated with light by the optical sensor 8 and a non-irradiated region not irradiated with light by the optical sensor 8. The potential difference ΔV indicates this potential difference at the same position in the width direction perpendicular to the direction of movement of the photosensitive member 1*d*. FIG. 8 shows that the potential difference ΔV between the irradiated region and the non-irradiated region decreases as a voltage applied to the primary transfer roller shifts in the negative direction.

Since the optical sensor 11 that detects the adjustment toner images 18Y, 18M, and 18C is disposed downstream of the primary transfer nip N1*d*, it is necessary that these adjustment toner images be passed through the primary transfer nip N1*d*. However, if the absolute value of the voltage of negative polarity (first polarity) applied to the primary transfer roller 9*d* is large, the adjustment toner images 18Y, 18M, and 18C may be excessively retransferred to the photosensitive drum 1*d*. This makes it difficult for the optical sensor 11 to properly detect the adjustment toner images 18Y, 18M, and 18C.

Figure 6:
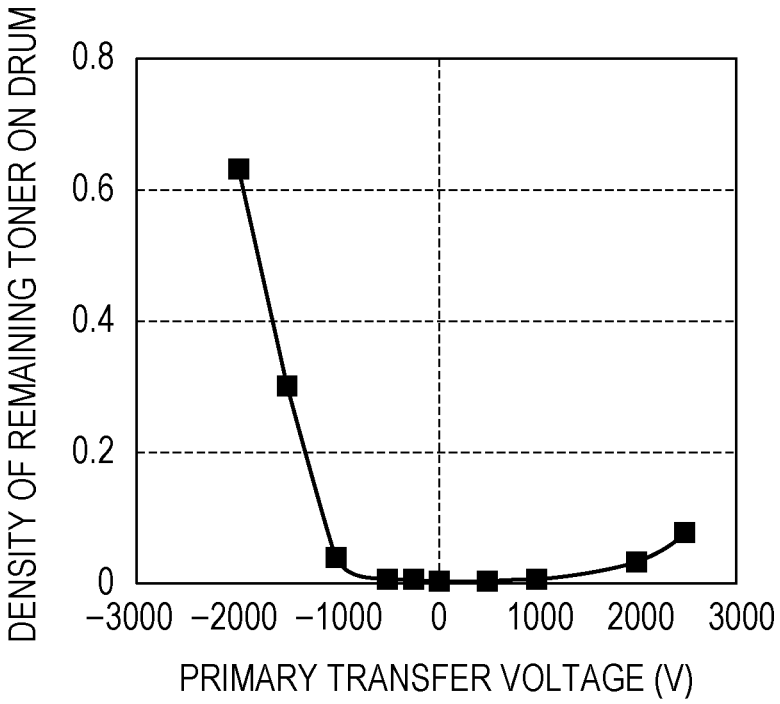
FIG. 6 illustrates a retransfer density of adjustment toner images with respect to a transfer voltage.

In FIG. 6, the horizontal axis represents a voltage applied to the primary transfer roller, and the vertical axis represents the density of toner of the adjustment toner images retransferred from the intermediate transfer belt to the photosensitive drum.

As illustrated in FIG. 6, when a voltage applied to the primary transfer roller is around −1000 V, the amount of retransfer of the adjustment toner images from the intermediate transfer belt 10 to the photosensitive drum 1*d* changes dramatically. The reason for this will now be described. If the absolute value of a voltage of negative polarity (first polarity) applied to the primary transfer roller exceeds 1000, a potential difference between the photosensitive drum 1*d* and the intermediate transfer belt exceeds a discharge start voltage and a discharge occurs. This results in a significant increase in the amount of retransfer of the adjustment toner images 18Y, 18M, and 18C for the intermediate transfer belt-facing sensor onto the photosensitive drum 1*d*. Therefore, to suppress retransfer of the adjustment toner images 18Y, 18M, and 18C, it is preferable to use a voltage lower than the discharge start voltage.

Thus, to suppress both the occurrence of exposure traces produced by the optical sensor and the retransfer of the adjustment toner images 18Y, 18M, and 18C, it is preferable that a voltage of negative polarity (first polarity) lower than the discharge start voltage be applied to the primary transfer roller 9*d*.

Figure 9:
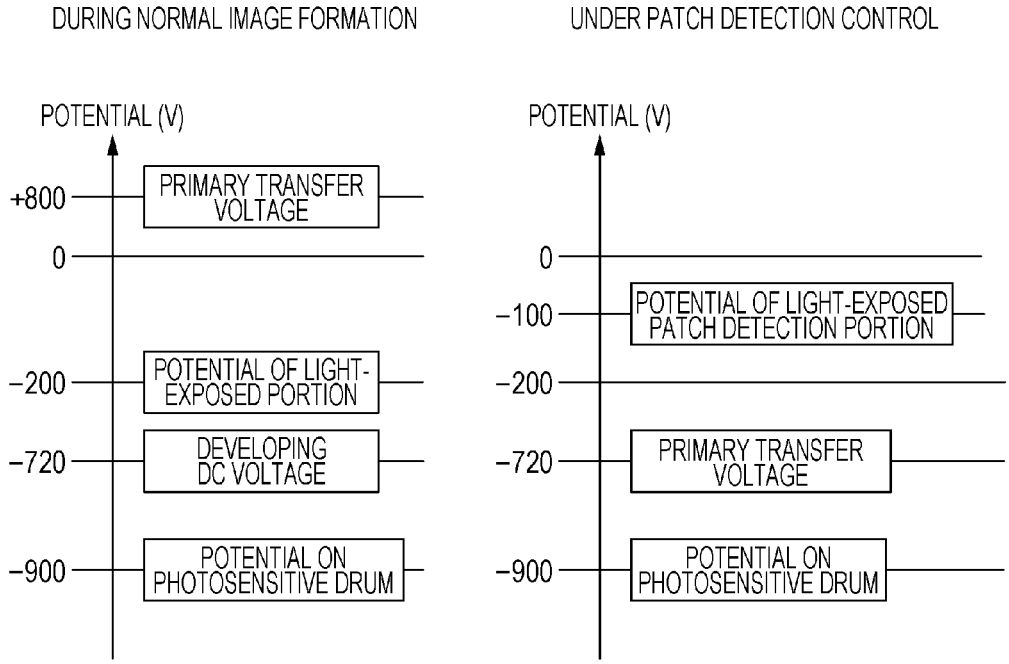
FIG. 9 illustrates a relationship of potentials in detecting patch images.

In the present embodiment, the transfer power supply 13 applies a voltage of −720 V to the primary transfer roller 9*d* when the adjustment toner images 18Y, 18M, 18C, and 18K pass through the primary transfer portion N1*d*. This voltage value is equal to a voltage value obtained by taking into account a fog-eliminating potential for a dark potential of the photosensitive drum in normal image formation, that is, equal to a DC voltage (developing voltage) applied to the developing device, as illustrated in FIG. 9. The reason for this will now be described. Toner does not move from a developing potential to a dark potential of the photosensitive drum. Therefore, by using the setting of a voltage applied to the developing device for the dark potential of the photosensitive drum, it is possible to reliably suppress retransfer of the adjustment toner images 18Y, 18M, and 18C from the intermediate transfer belt to the photosensitive drum. As illustrated in FIG. 9, for detecting adjustment toner images (patch images), the potential of a portion of the photosensitive drum 1*d* irradiated with light by the optical sensor 8 is −100 V, the potential of a portion of the photosensitive drum 1*d* exposed to light by the exposure device 3*d* without being irradiated with light by the optical sensor 8 is −200 V, a voltage applied to the primary transfer roller is −720 V, and the potential of a portion of the photosensitive drum 1*d* not exposed to light by the exposure device 3*d* is −900 V. That is, a voltage applied to the primary transfer roller 9*d* is between 0 V and the potential of the primary transfer roller 9*d*. This means that the absolute value of the potential of the photosensitive drum 1*d* is smaller than the absolute value of the potential of a dark portion of the photosensitive drum 1*d*.

<Transfer High-Voltage Control in Monochrome Image Formation>

Figure 10:
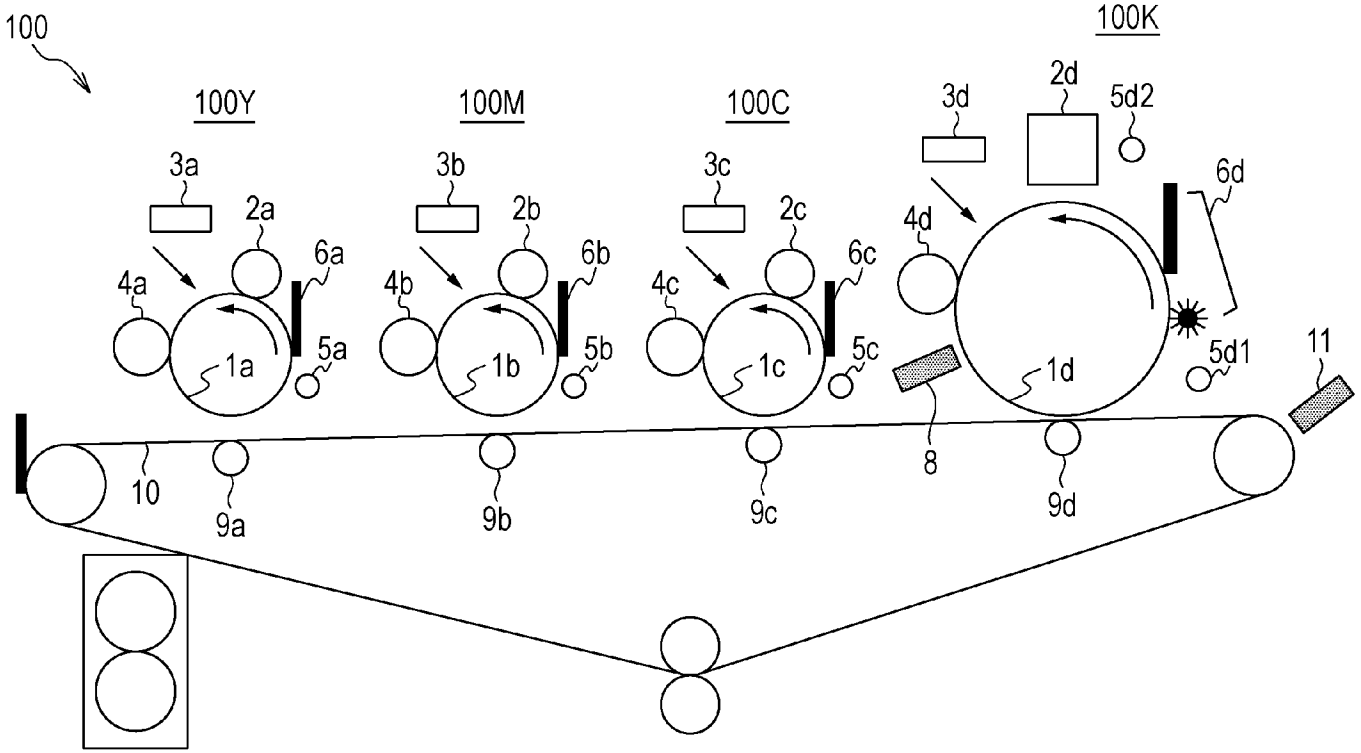
FIG. 10 schematically illustrates a configuration for monochrome image formation.
Figure 11:
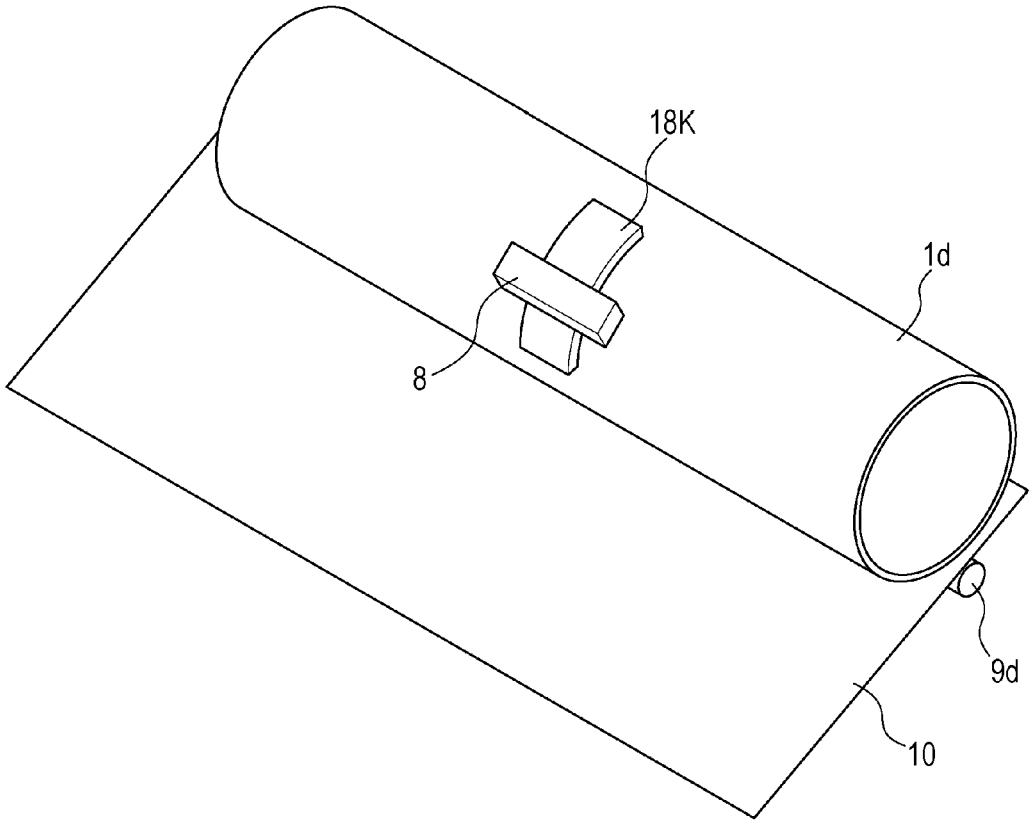
FIG. 11 is a bird's-eye view illustrating an entry into a transfer portion in monochrome image formation.

Transfer high-voltage control will be described which is performed when an adjustment toner image is formed in an inter-sheet space between recording materials in monochrome image formation. As illustrated in FIG. 10, in forming a monochrome image, the image forming stations 100Y, 100M, and 100C are separated from the intermediate transfer belt 10 and only the image forming station 100K is in contact with the intermediate transfer belt 10. Adjustment toner images of yellow, magenta, and cyan colors are not formed, and only an adjustment toner image of black color is formed here. FIG. 11 illustrates a state immediately before the adjustment toner image 18K formed in an inter-sheet space on the photosensitive drum 1*d* reaches the transfer roller 9*d*.

In the present embodiment, since the adjustment toner images 18Y, 18M, and 18C are not formed in monochrome image formation, there is no concern about retransfer of the adjustment toner images 18Y, 18M, and 18C. Therefore, when the adjustment toner image 18K passes through the primary transfer nip N1*d*, there is no need to take into account the retransfer of color adjustment toner images. In forming a monochrome image, it is necessary to reliably reduce the occurrence of exposure traces produced by the optical sensor. Specifically, in forming a monochrome image, when the adjustment toner image 18K of black color passes through the primary transfer nip N1*d*, a voltage Tb of negative polarity (first polarity) exceeding a discharge start voltage is applied to the primary transfer roller 9*d*. The resulting discharge between the photosensitive drum 1*d* and the intermediate transfer belt causes the surface of the photosensitive drum 1*d* to shift in the negative direction, so that the potential of the photosensitive drum 1*d* is separated from the ground potential. Thus, since the potential of the photosensitive drum 1*d* is less likely to be reversed to the positive polarity, the occurrence of exposure traces can be more reliably reduced.

In the present embodiment, a voltage applied to the primary transfer roller 9*d* when an adjustment toner image passes through the primary transfer nip N1*d* in forming a monochrome image is different from that in the case of forming a color image. However, it is to be understood that there is no intention to limit the present disclosure to this configuration. In another embodiment, a voltage applied to the primary transfer roller 9*d* when an adjustment toner image of black color passes through the primary transfer nip N1*d* in forming a monochrome image may be the same as that in the case of forming a color image. Specifically, when the adjustment toner image 18K passes through the primary transfer nip N1*d*, a voltage of −720 V may be applied to the primary transfer roller 9*d*. The setting can be simplified here, because the setting in monochrome image formation is the same as that in color image formation.

Figure 12:
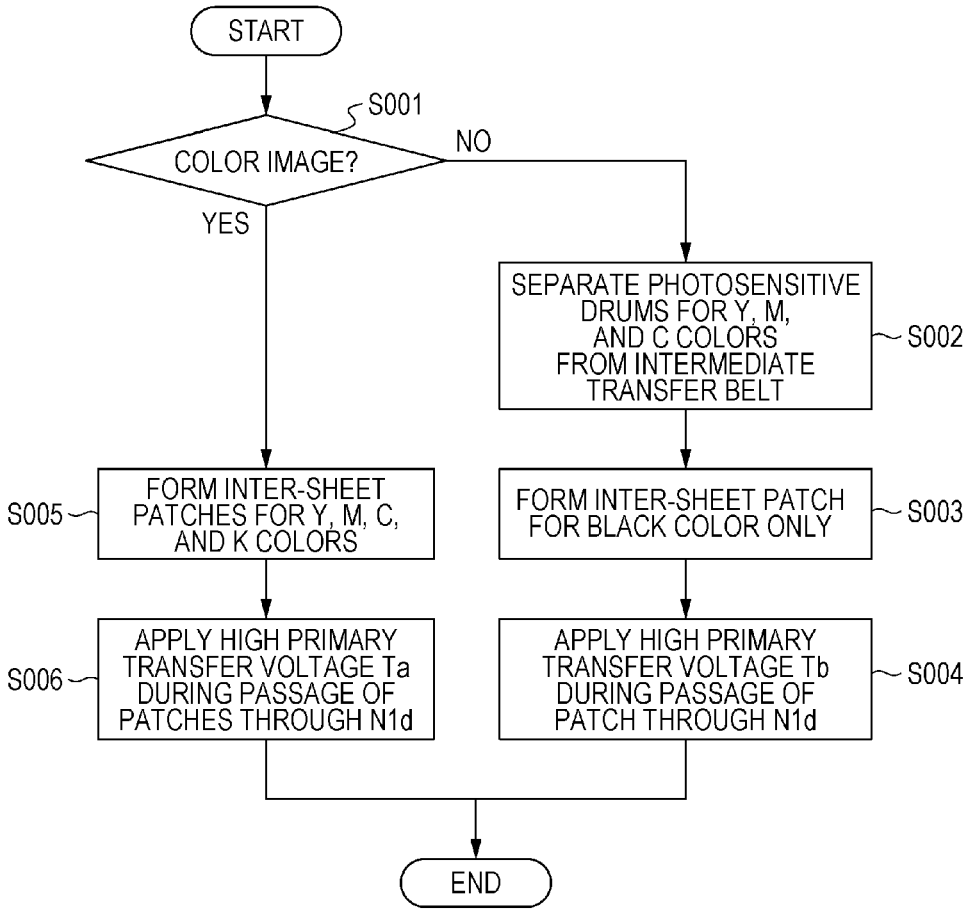
FIG. 12 is a flowchart illustrating transfer voltage control.

FIG. 12 is a flowchart of transfer voltage control in image formation. In step S001, a determination is made as to whether an image specified by the user is a color image. If it is determined in step S001 that the specified image is not a color image, a process of forming a monochrome image starts. To reduce wear of the photosensitive drums for Y, M, and C colors which are not to be used in this case, the photosensitive drums 1*a*, 1*b*, and 1*c* for Y, M, and C colors are separated from the intermediate transfer belt 10 (step S002). In step S003, the adjustment toner image 18K of black color is formed in an inter-sheet space between images. The adjustment toner images of Y, M, and C colors are not formed here. When the adjustment toner image 18K of black color passes through the primary transfer nip N1*d* on the most downstream side, a voltage Tb of negative polarity (first polarity) exceeding a discharge start voltage is applied to the primary transfer roller 9*d* (step S004). The reason for this will now be described. Unlike in the case of forming a color image, the adjustment toner images of Y, M, and C colors are not formed in forming a monochrome image. This is because when only the adjustment toner image 18K passes through the primary transfer nip N1*d* on the most downstream side, there is no need to take into account the retransfer of the adjustment toner images of Y, M, and C colors onto the photosensitive drum 1*d* on the most downstream side. Therefore, to reduce the occurrence of exposure traces on the photosensitive drum, a voltage of negative polarity (first polarity) exceeding the discharge start voltage is applied to the primary transfer roller 9*d*. Then the process ends. If it is determined in step S001 that the image specified by the user is a color image, the process proceeds to step S005, where the adjustment toner images 18Y, 18M, 18C, and 18K are formed for Y, M, C, and K colors. To suppress widening of a space for forming the adjustment toner images, the adjustment toner images 18Y, 18M, 18C, and 18K are formed at the same position in the direction of travel of the intermediate transfer belt 10, and at different positions in the width direction perpendicular to the direction of travel of the intermediate transfer belt 10. When the adjustment toner images 18Y, 18M, and 18C pass through the primary transfer portions N1*a*, N1*b*, and N1*c*, a transfer voltage equal to that for image formation is applied to the primary transfer rollers 9*a*, 9*b*, and 9*c*. Thus, the adjustment toner images 18Y, 18M, and 18C are transferred to the intermediate transfer belt 10. Then, when the adjustment toner images 18Y, 18M, 18C, and 18K pass through the primary transfer nip N1*d* on the most downstream side, a voltage of negative polarity (first polarity) lower than the discharge start voltage is applied to the primary transfer roller 9*d* on the most downstream side (step S006). Thus, it is possible to reduce the occurrence of exposure traces produced by the optical sensor 8 on the photosensitive drum 1*d* on the most downstream side, and to reduce the retransfer of the adjustment toner images 18Y, 18M, and 18C from the intermediate transfer belt 10 to the photosensitive drum 1*d*.

(Transfer High-Voltage Control in Previous Rotation)

Transfer high-voltage control performed in forming adjustment toner images during the previous rotation will now be described. As in the case of forming adjustment toner images between sheets, the adjustment toner images of Y, M, C, and K colors are formed at the same position in the direction of travel of the intermediate transfer belt 10 and at different positions in the width direction. For better accuracy in density adjustment, the length of the adjustment toner images in the direction of travel of the intermediate transfer belt 10 is longer than that in the case of forming adjustment toner images between sheets.

The setting for the primary transfer rollers 9*a*, 9*b*, and 9*c* is the same as that in the case of forming adjustment toner images in an inter-sheet space. However, the setting for the primary transfer roller 9*d* is different from that in the case of forming adjustment toner images in an inter-sheet space.

The reason for this will now be described. Because of the longer patch images, the optical sensor 8 repeatedly irradiates the photosensitive drum 1*d* with light. With repeated light irradiation from the optical sensor 8, the potential of the photosensitive drum 1*d* becomes closer to the ground potential. Therefore, in a region repeatedly irradiated with light, photocarriers generated on the photosensitive drum 1*d* by exposure to light from the charge eliminating devices 5*d*1 and 5*d*2 are less likely to be used in charge elimination. That is, the photocarriers generated on the photosensitive drum 1*d* by the charge eliminating devices 5*d*1 and 5*d*2 remain on the photosensitive drum 1*d* without disappearing immediately. If the photocarriers remain, the resulting changes in the electrical characteristics of the photosensitive drum 1*d* affect the process of development and transfer. If image formation is performed while photocarriers remain on the photosensitive drum 1*d*, traces may be left in the subsequent images. Therefore, it is preferable to reduce, as a negative effect of long-term exposure, the occurrence of traces in the subsequent images caused by the presence of the remaining photocarriers.

In the present embodiment, a recovery mode is executed in which, after a region irradiated with light by the optical sensor 8 passes through the primary transfer nip N1*d* and until the photosensitive drum 1*d* rotates at least once, a voltage of negative polarity (first polarity) higher than or equal to a discharge start voltage is applied to the primary transfer roller 9*d*. This makes it possible to reduce the occurrence of traces in the subsequent images (which is a negative effect of long-term exposure) caused by the presence of photocarriers that remain on the photosensitive drum 1*d* as a result of long-term exposure. The control unit 12 functions as an executing unit that executes the recovery mode.

Figure 13:
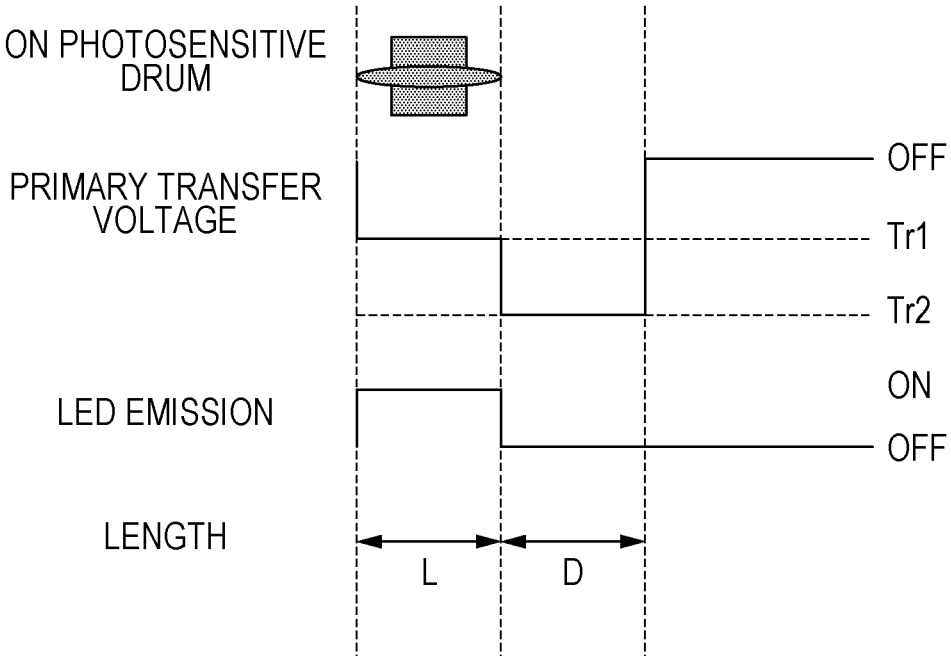
FIG. 13 illustrates transfer voltage control in the present embodiment.

FIG. 13 illustrates image forming conditions for examining the occurrence of exposure traces produced by the optical sensor 8 facing the photosensitive drum and the negative effect of long-term exposure. In FIG. 13, D denotes a circumference of the photosensitive drum 1*d*, which is 264 mm in the present embodiment, and L denotes a length of the adjustment toner images 18Y, 18M, 18C, and 18K, which is 912 mm, in the direction of travel of the intermediate transfer belt 10.

Tr1 (first voltage) is a voltage applied to the primary transfer roller 9*d* while the adjustment toner images 18Y, 18M, 18C, and 18K are passing through the primary transfer nip N1*d* from the leading edge to the trailing edge. Tr2 (second voltage) is a voltage applied to the primary transfer roller 9*d* after the trailing edge of the adjustment toner images 18Y, 18M, 18C, and 18K passes through the primary transfer nip N1*d* and until the photosensitive drum 1*d* rotates once. The conditions Tr1 and Tr2 were varied to examine the occurrence of traces in the subsequent image (exposure traces) caused by reversal of the surface potential of the photosensitive drum, and the occurrence of traces in the subsequent images (which is a negative effect of long-term exposure) caused by the presence of photocarriers remaining as a result of long-term exposure. The result is shown in Table 2.

TABLE 2

Negative Effect under Varying Transfer Voltage Conditions

| Tr1 | Tr2 | Exposure Traces | Negative effect of Long-Term Exposure |
|---|---|---|---|
| 200 | 200 | YES | YES |
| | 100 | YES | YES |
| | 0 | YES | YES |
| | −500 | YES | YES |
| | −1000 | YES | YES |
| | −1500 | YES | NO |
| | −2000 | YES | NO |
| 0 | 200 | YES | YES |
| | 100 | YES | YES |
| | 0 | YES | YES |
| | −500 | YES | YES |
| | −1000 | YES | YES |
| | −1500 | YES | NO |
| | −2000 | YES | NO |
| −500 | 200 | NO | YES |
| | 100 | NO | YES |
| | 0 | NO | YES |
| | −500 | NO | YES |
| | −1000 | NO | YES |
| | −1500 | NO | NO |
| | −2000 | NO | NO |
| −1000 | 200 | NO | YES |
| | 100 | NO | YES |
| | 0 | NO | YES |
| | −500 | NO | YES |
| | −1000 | NO | YES |
| | −1500 | NO | NO |
| | −2000 | NO | NO |

TABLE 2-continued

| Negative Effect under Varying Transfer Voltage Conditions | | | |
|---|---|---|---|
| Tr1 | Tr2 | Exposure Traces | Negative effect of Long-Term Exposure |
| −1500 | 200 | NO | YES |
| | 100 | NO | YES |
| | 0 | NO | YES |
| | −500 | NO | YES |
| | −1000 | NO | YES |
| | −1500 | NO | NO |
| | −2000 | NO | NO |
| −2000 | 200 | NO | YES |
| | 100 | NO | YES |
| | 0 | NO | YES |
| | −500 | NO | YES |
| | −1000 | NO | YES |
| | −1500 | NO | NO |
| | −2000 | NO | NO |

Table 2 shows that the occurrence of exposure traces caused by reversal of the surface potential of the photosensitive drum can be reduced when the voltage Tr1 (first voltage) applied when adjustment toner images pass through the primary transfer nip N1*d* is set to a voltage of negative polarity (first polarity) lower than the discharge start voltage. To reduce, as a negative effect of long-term exposure, the occurrence of traces in the subsequent images caused by the presence of the remaining photocarriers, it is preferable that Tr2 (second voltage) be set to a voltage of negative polarity (first polarity) higher than or equal to the discharge start voltage. The reason for this will now be described with reference to FIGS. 14 to 17.

Figure 14:
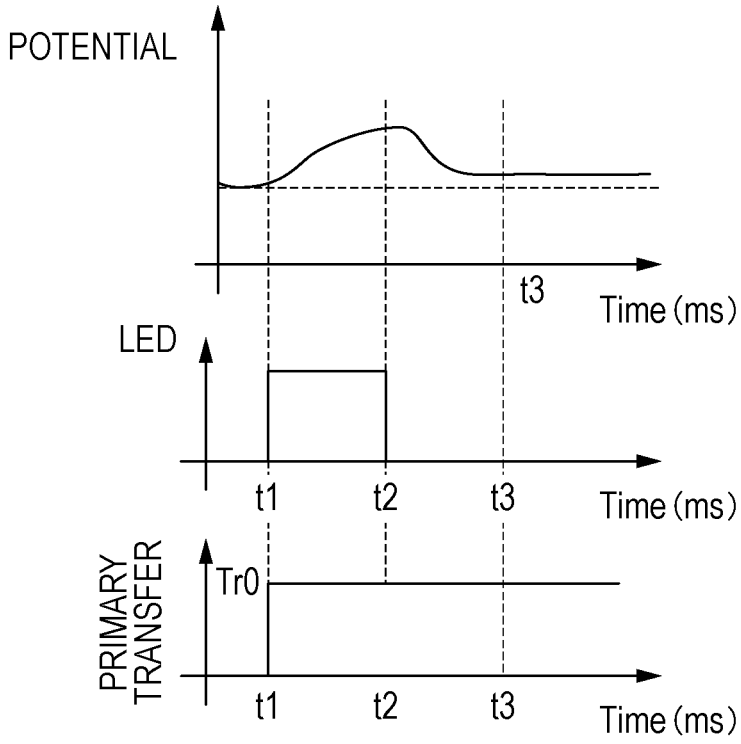
FIG. 14 illustrates how a potential changes with time in related art.

FIG. 14 (related art) illustrates how a potential changes when a transfer voltage for forming an image is continued to be applied not only while the adjustment toner images 18Y, 18M, 18C, and 18K are passing through the primary transfer nip N1*d*, but also after the adjustment toner images pass through the primary transfer nip N1*d*. The horizontal axes each represent time, and the vertical axes represent a dark potential on the photosensitive drum 1*d*, an on/off state of the LED, and a voltage applied to the primary transfer roller 9*d*. The duration from time t1 to time t2 corresponds to a region subjected to LED irradiation by the optical sensor 8. The duration from time t2 to time t3 is a range in which the photosensitive drum rotates once after the region irradiated by the optical sensor 8 (corresponding to the region where the adjustment toner images are formed) passes through the primary transfer nip N1*d*.

In this case, when the irradiated region passes through the primary transfer nip, the potential of the irradiated region is positively charged significantly by application of a positive transfer voltage. Therefore, the potential of the irradiated region subjected to LED irradiation by the optical sensor is dramatically shifted in the positive direction and reversed from negative to positive. As a result, reversal of the polarity of the photosensitive drum causes image defects (exposure traces). Photocarriers generated in the region repeatedly irradiated with light by the optical sensor remain on the photosensitive drum without disappearing immediately after the region is irradiated with light by the optical sensor. As a negative effect of long-term exposure, this results in the occurrence of image defects caused by the presence of the remaining photocarriers. Due to the effect of photocarriers and the effect of charging at the primary transfer nip N1*d*, the potential of the photosensitive drum 1*d* is not returned to the dark potential (indicated by a horizontal dotted line in the drawing) obtained before the photosensitive drum 1*d* is irradiated by the optical sensor.

Figure 15:
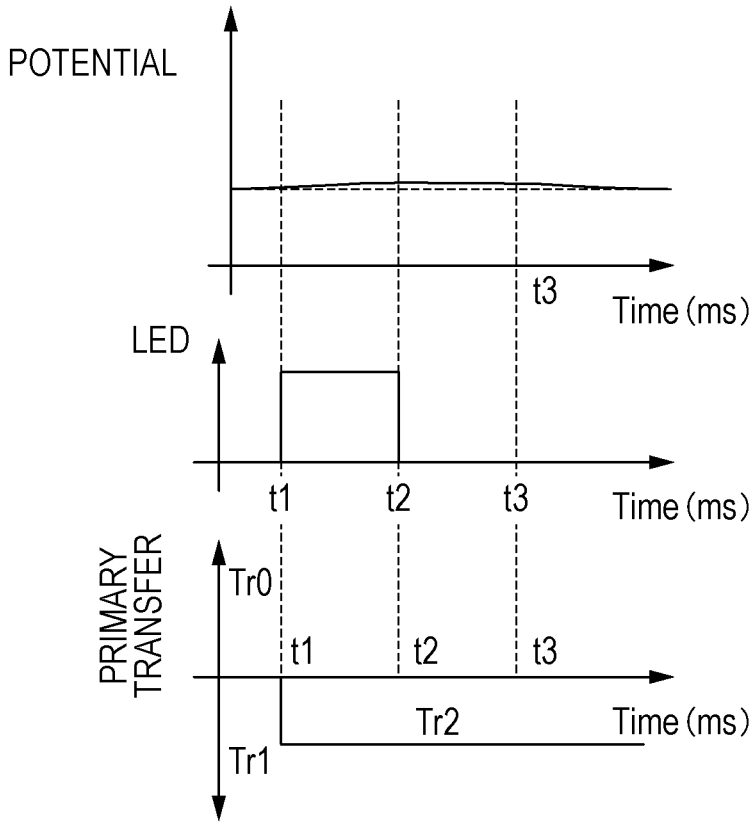
FIG. 15 illustrates how a potential changes with time in Comparative Example 1.

FIG. 15 (Comparative Example 1) illustrates how a potential changes when Tr1 and Tr2 are voltages of negative polarity (first polarity) lower than the discharge start voltage.

In this case, since a voltage of negative polarity (first polarity) is applied at the primary transfer nip, the potential of the surface of the photosensitive drum can be prevented from being reversed to positive at the primary transfer nip. Therefore, it is possible to reduce the occurrence of exposure traces caused by reversal of the potential of the photosensitive drum. However, in a region repeatedly irradiated with light by the optical sensor, photocarriers generated on the photosensitive drum by exposure to light from the charge eliminating devices after transfer are less likely to be used in charge elimination. As a result, the photocarriers remain on the photosensitive drum without disappearing immediately. As a negative effect of long-term exposure, this results in image defects caused by the presence of the remaining photocarriers. Additionally, due to the effect of photocarriers remaining on the photosensitive drum, it takes time for the potential of the photosensitive drum to return to the original dark potential.

Figure 16:
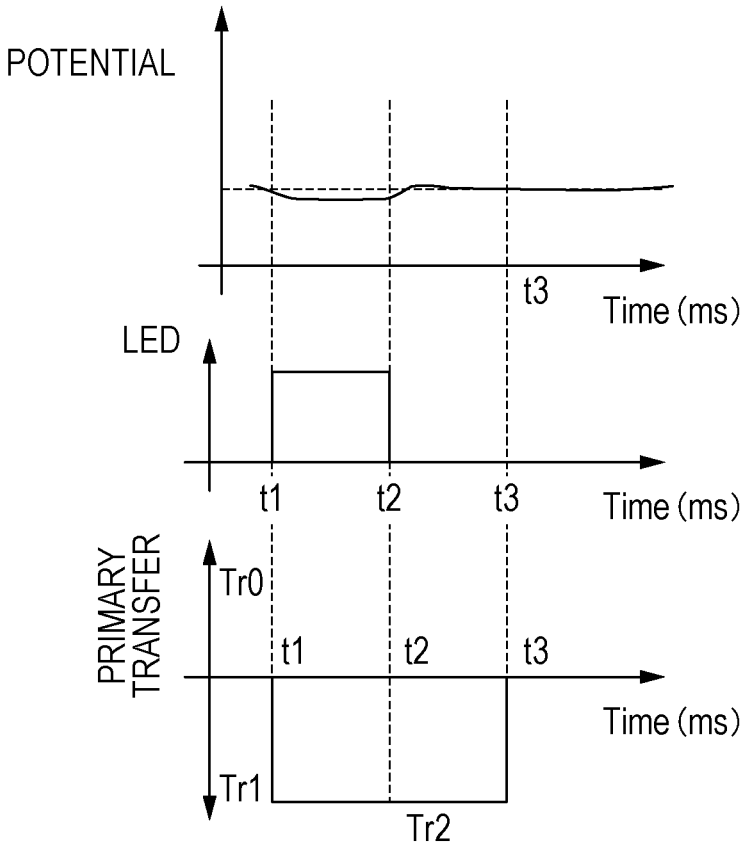
FIG. 16 illustrates how a potential changes with time in Comparative Example 2.

FIG. 16 (Comparative Example 2) illustrates how a potential changes when both Tr1 and Tr2 are voltages of negative polarity (first polarity) higher than or equal to the discharge start voltage.

In this case, when an irradiated region passes through the primary transfer nip, a discharge occurs between the photosensitive drum and the intermediate transfer belt. Thus, the potential of the photosensitive drum is negatively charged significantly. Therefore, if the length of patch images is longer than the circumference of the photosensitive drum, the dark potential for forming the leading edge portions of the patch images is different from that for forming the trailing edge portions of the patch images. Since the patch images are formed under nonuniform conditions, unevenness in density of the patch images occurs. If the length of the patch images is longer than the circumference of the photosensitive drum, it is difficult to properly adjust image forming conditions using adjustment toner images. On the other hand, since the surface of the photosensitive drum is negatively charged again at the primary transfer nip, the potential of the photosensitive drum can be prevented from being reversed to positive. Additionally, a high voltage applied at the primary transfer nip facilitates movement of photocarriers generated on the photosensitive drum by the charge eliminating devices. Since this speeds up the disappearance of photocarriers remaining on the photosensitive drum, it is possible to reduce, as a negative effect of long-term exposure, the occurrence of image defects caused by the presence of remaining photocarriers.

Figure 17:
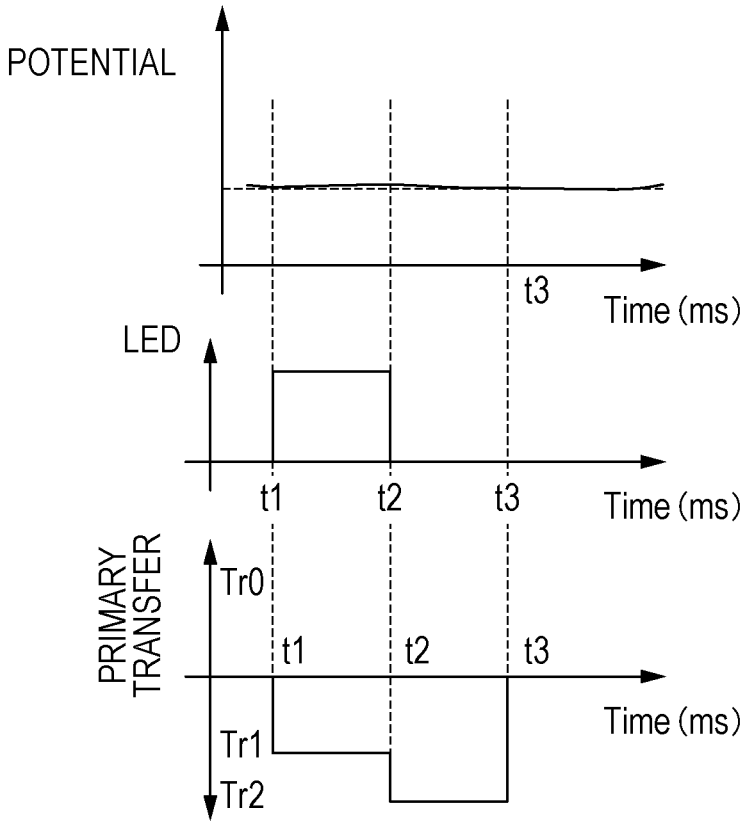
FIG. 17 illustrates how a potential changes with time in the present embodiment.

FIG. 17 illustrates the setting of Tr1 and Tr2 in the present embodiment based on the results shown in FIGS. 14 to 16. Specifically, in the present embodiment, the control unit 12 sets the first voltage Tr1 to a voltage of negative polarity (first polarity) lower than the discharge start voltage, and sets the second voltage Tr2 to a voltage of negative polarity (first polarity) higher than or equal to the discharge start voltage. That is, when the adjustment toner images pass through the primary transfer nip N1*d*, a voltage of negative polarity (first polarity) lower than the discharge start voltage is applied to the primary transfer roller 9*d*. Since the potential of the photosensitive drum can be prevented from being reversed, it is possible to reduce the occurrence of exposure traces produced in the subsequent image by the optical sensor 8. Since can be prevented from being reversed, it. After irradiation by the optical sensor 8, a voltage of negative polarity (first polarity) higher than or equal to the discharge start voltage is applied to the primary transfer roller 9*d* during one rotation of the photosensitive drum 1*d*. The reason for this will be described. In a region repeatedly irradiated with light, photocarriers generated by exposure to light from the charge eliminating devices are less likely to be used in charge elimination and remain on the photosensitive drum. The photocarriers remaining on the photosensitive drum may cause defects in the subsequent images if not disappearing immediately. However, applying a voltage higher than or equal to the discharge start voltage at the primary transfer nip facilitates movement of photocarriers remaining on the photosensitive drum at the primary transfer nip. Since this speeds up the disappearance of the photocarriers, it is possible to reduce, as a negative effect of long-term irradiation, the occurrence of defects in the subsequent images caused by the presence of the remaining photocarriers. In the present embodiment, the second voltage Tr2 is applied to the primary transfer roller during one rotation of the photosensitive drum. However, there is no intention to limit the scope of the present disclosure to this. The second voltage Tr2 may be applied to the primary transfer roller during one or more rotations of the photosensitive drum.

Since there is no optical sensor that faces the photosensitive drums 1*a*, 1*b*, and 1*c*, voltage control that reduces a negative effect of long-term exposure is not necessary for the photosensitive drums 1*a*, 1*b*, and 1*c*. No voltage is applied to the primary transfer rollers 9*a*, 9*b*, and 9*c* while a voltage higher than or equal to a discharge start voltage is being applied to the primary transfer roller 9*d* to reduce a negative effect of long-term exposure on the photosensitive drum 1*d*.

The present disclosure generally relates to a configuration in which an optical sensor for detecting an adjustment toner image of black color is disposed on an image bearing member and an optical sensor for detecting adjustment toner images of other colors is disposed on an intermediate transfer member. With this configuration, even if the adjustment toner images of black and other colors simultaneously pass through a transfer portion for black color to reduce downtime, it is possible to reduce an effect on the subsequent image caused by light irradiation from the optical sensor and, at the same time, to prevent adjustment toner images of other colors from being excessively retransferred to the image bearing member (for black color) due to discharge.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims priority from International Patent Application No. PCT/JP2011/079340 filed Dec. 19, 2011, which is hereby incorporated by reference herein in its entirety.

What is claimed is:

1. An image forming apparatus comprising:

an intermediate transfer member configured to be a movable member to which toner images are transferred;

a first image bearing member configured to come into contact with the intermediate transfer member, the first image bearing member having a photosensitive layer bearing a chromatic toner image of a first polarity;

a second image bearing member configured to come into contact with the intermediate transfer member at a location downstream of the first image bearing member in a direction of travel of the intermediate transfer member, the second image bearing member having a photosensitive layer bearing a black toner image of the first polarity;

a first transfer member configured to transfer a toner image from the first image bearing member to the intermediate transfer member at a first transfer portion;

a second transfer member configured to transfer a toner image from the second image bearing member to the intermediate transfer member at a second transfer portion;

a voltage applying member configured to apply a voltage to the first transfer member and the second transfer member;

a first detector configured to detect an adjustment toner image of chromatic color by irradiating the intermediate transfer member with light, the first detector being disposed downstream of the second image bearing member in the direction of travel of the intermediate transfer member;

a second detector configured to detect an adjustment toner image of black color by irradiating the second image bearing member with light; and an adjusting portion configured to adjust an image forming condition for the first image bearing member based on a result obtained using the first detector by detecting a first adjustment toner image transferred from the first image bearing member to the intermediate transfer member, and adjusting an image forming condition for the second image bearing member based on a result obtained using the second detector by detecting a second adjustment toner image formed on the second image bearing member, wherein the voltage applying member is controlled such that when the first adjustment toner image and the second adjustment toner image simultaneously pass through the second transfer portion in the direction of travel of the intermediate transfer member, a first voltage of the first polarity is applied to the second transfer member, the first voltage being a voltage that makes a potential difference between the second image bearing member and the intermediate transfer member less than a discharge start voltage.

2. The image forming apparatus according to claim 1, wherein an absolute value of the first voltage is smaller than an absolute value of a potential of the second image bearing member.

3. The image forming apparatus according to claim 1, wherein the first voltage is equal to a developing voltage applied to a developing unit configured to develop toner on the second image bearing member.

4. The image forming apparatus according to claim 1, wherein the voltage applying member is controlled such that when only the second adjustment toner image passes through the second transfer portion in the direction of travel of the intermediate transfer member, a voltage of the first polarity is applied to the second transfer member, the voltage being a voltage that makes a potential difference between the second image bearing member and the intermediate transfer member greater than or equal to a discharge start voltage.

5. The image forming apparatus according to claim 1, wherein the first adjustment toner image and the second adjustment toner image are formed in a region corresponding to a space between recording materials.

6. The image forming apparatus according to claim 1, wherein if the first and second adjustment toner images are greater in length, in a direction of movement of the second image bearing member, than a predetermined value greater than or equal to a circumference of the second image bearing member, a second voltage of the first polarity is applied to the second transfer member during one rotation of the second image bearing member after the second adjustment toner image passes through the second transfer portion, the second voltage being a voltage that makes a potential difference between the second image bearing member and the intermediate transfer member greater than or equal to the discharge start voltage.

7. The image forming apparatus according to claim 6, wherein if the first and second adjustment toner images are not greater in length, in the direction of movement of the second image bearing member, than the circumference of the second image bearing member, the second voltage is not applied during one rotation of the second image bearing member after the second adjustment toner image passes through the second transfer portion.

* * * * *